US006098440A

United States Patent [19]

Görgen

[11] Patent Number: 6,098,440

[45] Date of Patent: Aug. 8, 2000

[54] DEVICE FOR HEMMING OF SHEET METALS PARTICULARLY OF COACHWORK SHEET METALS FOR SMALL-LOT PRODUCTION SERIES IN AUTOMOBILE MANUFACTURE

[75] Inventor: Josef Görgen, Weiskirchen, Germany

[73] Assignee: Thyssen Krupp AG, Essen, Germany

[21] Appl. No.: 09/211,097

[22] Filed: Dec. 14, 1998

[30] Foreign Application Priority Data

Dec. 19, 1997 [DE] Germany ..... 197 56 651

[51] Int. Cl.[7] ..... B21D 5/04; B21D 39/02

[52] U.S. Cl. ..... 72/312; 72/323; 72/413; 29/243.58

[58] Field of Search ..... 72/312–315, 323, 72/389.4, 448, 446, 472, 404, 413; 29/243.58

[56] References Cited

U.S. PATENT DOCUMENTS

| | | | |
|---|---|---|---|
| 3,071,176 | 1/1963 | Askinazy | 72/404 |
| 3,566,665 | 3/1971 | Birrer | 72/404 |
| 4,866,975 | 9/1989 | Hopkins | 72/448 |
| 4,930,332 | 6/1990 | Hongo | 72/323 |
| 5,150,508 | 9/1992 | St. Denis | 29/243.5 |
| 5,228,190 | 7/1993 | Sawa | 72/220 |

FOREIGN PATENT DOCUMENTS

| | | | |
|---|---|---|---|
| 44 18 684 A1 | 11/1995 | Germany | 72/312 |
| 60-170529 | 9/1985 | Japan | 72/389.4 |

*Primary Examiner*—Daniel C. Crane
*Attorney, Agent, or Firm*—McGlew and Tuttle PC

[57] ABSTRACT

A device for hemming of sheet metals, particularly of coachwork sheet metals for small-lot production series in automobile manufacture is disclosed. A ram with a superimposed hemming bed is arranged in a base rack presses the sheet metals to be hemmed against the hemming jaws of the pre-hemming and/or finish hemming tools. One or more hemming jaws (8, 8') are affixed to a rotary head (4) lying opposite to the ram (2) and are swingable by turning the rotary head (4) in working position. Moreover, the invention provides for that the hemming bed (5) is linearly traversable or swingable in horizontal plane between a loading point (B) and a working point (A).

9 Claims, 2 Drawing Sheets

DEVICE FOR HEMMING OF SHEET METALS PARTICULARLY OF COACHWORK SHEET METALS FOR SMALL-LOT PRODUCTION SERIES IN AUTOMOBILE MANUFACTURE

FIELD OF THE INVENTION

The invention relates to a device for hemming of sheet metals, particularly of coachwork sheet metals for small-lot production series in automobile manufacture, wherein a ram nested in a base rack and provided with a superimposed hemming bed presses the sheet metals to be hemmed against pre-hemming and/or finish hemming tools.

BACKGROUND OF THE INVENTION

Nowadays it is common practice to install hemming tools into presses or stroke racks. For the various hemming stages, two tools and thus two presses are needed or one of the two foldings is executed through a complicated slide or flap technique.

From DE 44 18684 A1 it is known to provide a method for joining of sheet metals by means of bordering. The parts to be joined are machined in a press in at least one pre-bordering and finish bordering. A pre-bordering of the parts during a first transformation phase is effected by means of a prebordering edge of a mobile slide. The slide then moves radially towards the outside. A second bordering tool with a bordering edge during a second transformation phase executes a finish bordering of the parts to be joined together. Both the loading of tools in the press with the parts to be machined and the take-out of machined sheet metals are relatively expensive according to this method.

U.S. Pat. No. 5,150,508 describes a generic bordering device for two sheet metals with a highstanding flange lying one above each other, wherein a ram with a superimposed hemming bed in a base rack presses the sheet metals to be hemmed consecutively against the hemming jaws of the pre-hemming and finish hemming tools. In the process the hemming tools are moved radially from outside to inside consecutively into the hemming position and the hemming bed is adjusted in height for the individual hemming procedures. Here, too, the change of tools is very expensive.

SUMMARY AND OBJECTS OF THE INVENTION

It is the primary object of the invention, by way of applying the simplest possible tools, particularly for small-lot production or for niche vehicles, to enable the execution of one or several hemming operation(s), to simplify loading and unloading, and to enable execution of additional work such as application of bonding cement, purification, etc. in the hemming bed without any additional take-up technique.

According to the invention, a device for hemming of sheet metals is provided which is particularly useful for coachwork sheet metals for small-lot production series in automobile manufacture. A ram with a superimposed hemming bed arranged in a base rack presses the sheet metals to be hemmed against the hemming jaws of the pre-hemming and/or finish hemming tools. One or several hemming jaw tools are affixed to a rotary head lying opposite to the ram and are swingable by turning the rotary head in a working position.

In case that the ram is arranged in a base rack standing on the ground, it presses the hemming bed with the sheet metals to be hemmed from below against the hemming jaw tool affixed to the rotary head. Initially the ram presses the hemming bed with the superimposed sheet metals against the hemming jaw tool to effect the pre-hemming procedure. When the ram has been lowered, the rotary head can for example be turned by 90°, and the finish hemming jaw tool can be brought into position. As provided for under this invention at least as many different hemming jaw tools may be mounted at the rotary head as hemming procedures for joining of sheet metals are required. Moreover, it has turned out to be favorable to affix a particularly controlled holding-down appliance at the rotary head.

To attain the object which is the subject of this invention it is moreover proposed that the hemming bed shall be linearly traversable or swingable in horizontal plane, preferably on a table or by application of a similar traversing unit between a loading point and a working point. The hemming bed and/or the table with the hemming bed affixed on it may be equipped with a driving unit for traversing from the loading point into the working point and vice versa. By moving-out the hemming bed into a separate loading point, the good accessibility makes it easy for one operator only to execute in particular the following work steps:

a) loading of the external skin;

b) application of the bonding cement for hemming;

c) joining of the internal part;

d) cleaning of the part;

e) take-out of the hemmed part.

By integrating an induction loop it is feasible to execute the jelling of the bonding cement quickly and precisely.

A change of the hemming jaw tools affixed to the rotary head can be executed automatically and within a very short time, for example in such a manner that the hemming jaw tools are taken-up and/or given away manually or by means of a grab in lateral or upper position of the tool. But it is also feasible to change the hemming jaw tools while being in the working position and to move them by means of the traversable table from the working position into the loading point and to transfer them from there via appropriate devices to a stacking rack.

The device being the subject of this invention is particularly suitable for small-lot production series or so-called niche vehicles, because tools can be changed in a simple and quick manner. Moreover, it is feasible to execute additional work when being in the loading position, e.g. application of bonding cement, cleaning, etc. in the hemming bed without any additional take-up technique.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
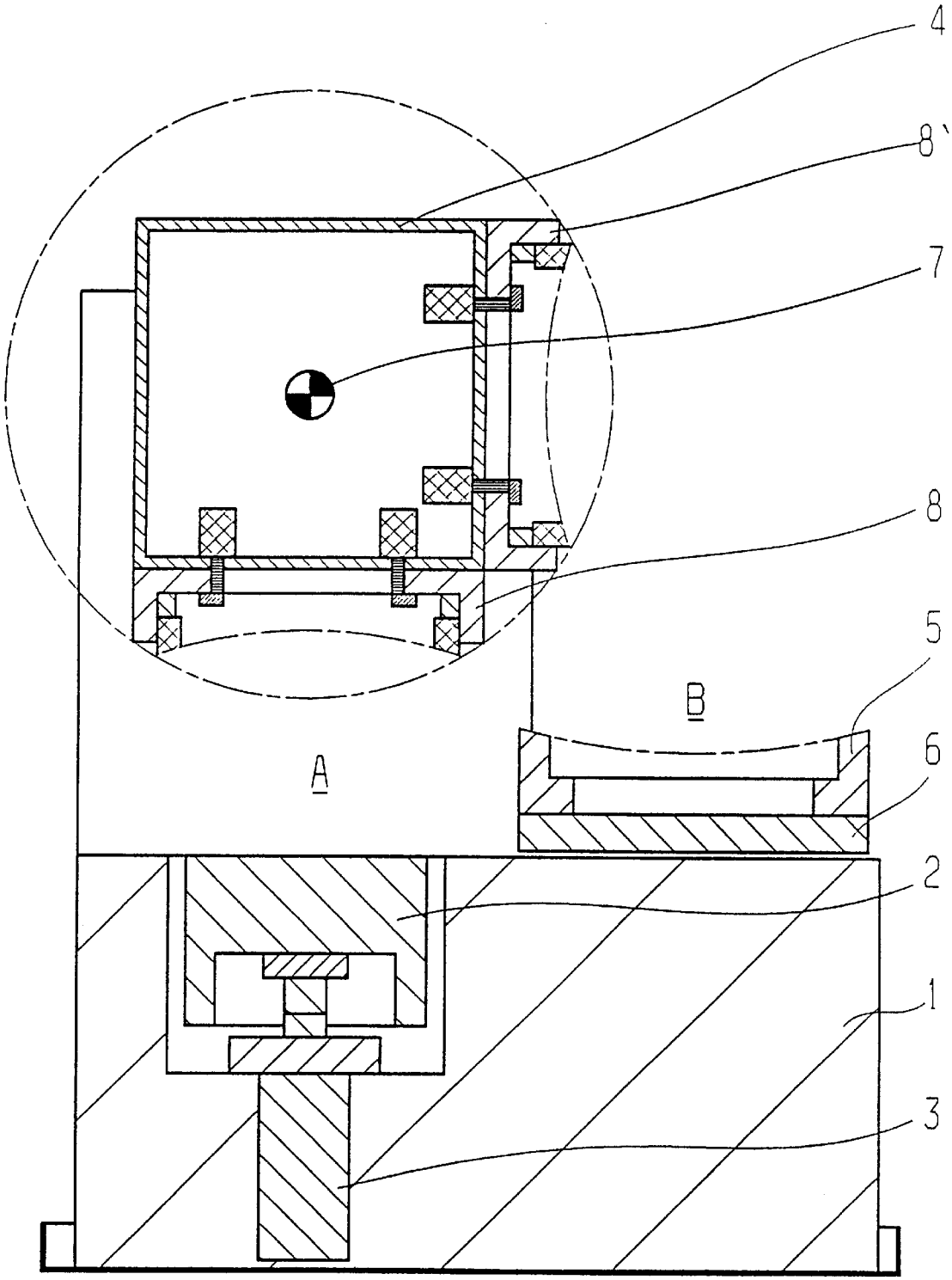
FIG. 1 is a side view of a first embodiment of the invention.

Referring to the drawings in particular, pursuant to FIG. 1 a ram 2 with a drive unit 3 acting in vertical direction is arranged in a base rack 1. The table 6 for take-up of hemming bed 5 may be mounted firmly on the ram 2 or be equipped with a drive unit. By way of table 6, the hemming bed 5 is moved from the loading point B to working point A and back. The hemming jaw tools 8, 8' for pre-hemming and finish hemming are affixed to rotary head 4 and can be brought into working position around rotary axis 7. Rotary head 4 can take-up several hemming jaw tools 8, 8' depending on construction style applied.

Figure 2:
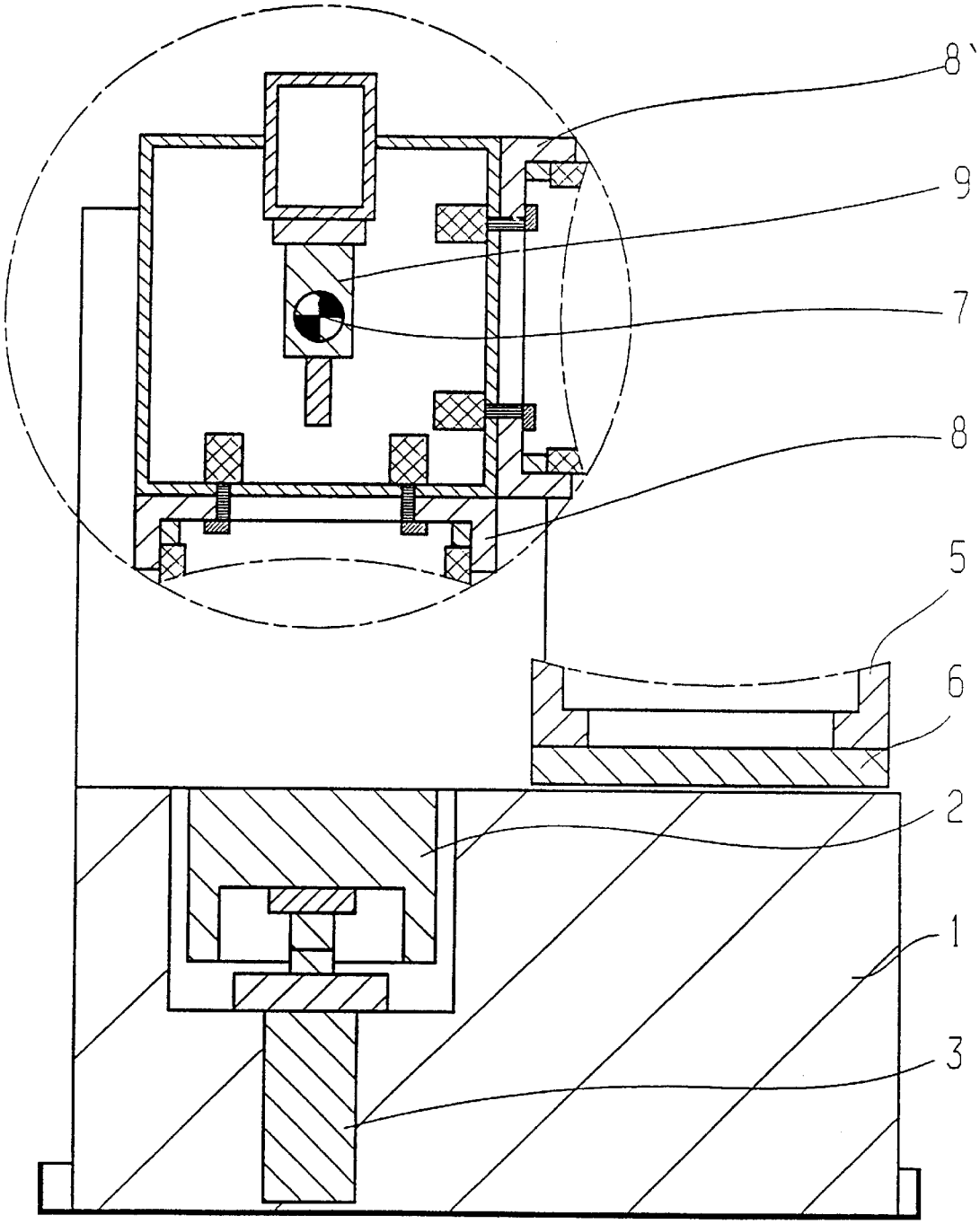
FIG. 2 is a side view of second embodiment of the invention.

FIG. 2 shows a similar construction style to the device shown in FIG. 1. A ram 2 has a drive unit 3 which acts in a vertical direction and is arranged in a base rack 1. The table 6 for take-up of hemming bed 5 may be mounted firmly on the ram 2 or be equipped with a drive unit. By way of table 6, the hemming bed 5 is moved from the loading point B to working point A and back. The hemming jaw tools 8, 8' for pre-hemming and finish hemming are affixed to rotary head 4 and can be brought into working position around rotary axis 7. Rotary head 4 can take-up several hemming jaw tools 8, 8' depending on construction style applied. Further, the device of FIG. 2 has a controlled holding-down appliance 9.

While specific embodiments of the invention have been shown and described in detail to illustrate the application of the principles of the invention, it will be understood that the invention may be embodied otherwise without departing from such principles.

What is claimed is:

1. A device for hemming of coachwork sheet metals for small-lot production series in automobile manufacture, the device comprising:

a base rack;

a hemming bed;

a ram with said hemming bed being positionable superimposed thereon, said ram being arranged in said base rack;

a rotary head including a first hemming jaw tool with a pre-hemming jaw and a second hemming jaw tool with a finish hemming jaw for pre-hemming and finish hemming, said tools being consecutively swingable into a working position, said rotary head being provided opposite to said ram and swingable by turning said rotary head into said working positions for pressing the sheet metals to be hemmed against said pre-hemming and finish hemming jaws of said hemming tool.

2. The device according to claim 1, wherein a holding-down appliance is affixed to said rotary head.

3. The device according to claim 1, wherein said hemming bed is traversable or swingable on a table or with a similar traversing unit.

4. A device for hemming of sheet metal, the device comprising a base rack;

a hemming bed for receiving first and second sheets on top of each other, said hemming bed being movable on said base rack between a loading point and a working point;

a rotary head at said working point, said rotary head including a pre-hemming tool and a final hemming tool rotatable into a working position;

a ram with said hemming bed being positionable superimposed thereon, said ram being arranged in said base rack, said ram moving said hemming bed toward said rotary head for pre-hemming and final hemming of said first and second sheets with said pre-hemming and final hemming tools in said working position;

said hemming bed being receivable of one of said tools for moving said one tool away from said rotary head, from said working point to said loading point and a subsequent transfer to a stacking shelf.

5. A device according to claim 4, wherein:

said tools are consecutively swingable into the working position.

6. The device according to claim 4, wherein a holding-down appliance is affixed to said rotary head.

7. The device according to claim 4, wherein said hemming bed is arranged linearly traversable or swingable in horizontal plane between said loading point and said working point superimposed on said ram.

8. The device according to claim 7, wherein said hemming bed is traversable or swingable on a table or with a similar traversing unit.

9. A method for hemming sheets, the method comprising the steps of:

providing a base rack;

providing a hemming bed movable on said base rack between a loading point and a working point;

placing a first sheet on said hemming bed at said loading point;

placing a second sheet on said first sheet at said loading point;

providing a rotary head at said working point, said rotary head including a pre-hemming tool and a final hemming tool;

moving said hemming bed with said first and second sheets to said working point;

rotating said pre-hemming tool into a working position;

moving said hemming bed toward said pre-hemming tool to pre-hem said first and second sheets;

rotating said final hemming tool into said working position;

moving said hemming bed toward said final hemming tool to finish hemming said first and second sheets;

moving said hemming bed with hemmed said first and second sheets to said loading point;

removing said hemmed first and second sheets from said hemming bed.

* * * * *